US005160515A

United States Patent [19]

Nelson et al.

[11] Patent Number: 5,160,515

[45] Date of Patent: Nov. 3, 1992

[54] ASPIRATION UNIT FOR CONDITIONING AIR DURING RAIL CAR UNLOADING OF PERISHABLE FOOD PRODUCTS

[75] Inventors: John L. Nelson, Naperville, Ill.; David Houldey, London, Canada

[73] Assignee: CPC International Inc., Englewood Cliffs, N.J.

[21] Appl. No.: 764,539

[22] Filed: Sep. 24, 1991

[51] Int. Cl.[5] ..... B01D 46/00

[52] U.S. Cl. ..... 55/267; 55/279; 55/310; 55/385.4; 220/745; 422/24; 422/173

[58] Field of Search ..... 55/385.4, 279, 267, 55/310; 422/24, 173; 220/745

[56] References Cited

U.S. PATENT DOCUMENTS

| | | | |
|---|---|---|---|
| 1,811,529 | 6/1931 | Barstow et al. | 98/8 |
| 1,921,178 | 6/1932 | Wood | 62/117 |
| 2,605,689 | 3/1946 | O'Connor | 98/6 |
| 2,976,950 | 3/1961 | Smith | 55/385.4 |
| 3,048,958 | 8/1962 | Barnes | 220/745 |
| 3,194,144 | 7/1965 | Vander Linden | 98/6 |
| 3,326,111 | 6/1967 | Stevens | 98/6 |
| 3,731,053 | 5/1973 | Coyle et al. | 219/202 |
| 3,757,495 | 9/1973 | Sievers | 55/279 |
| 4,315,579 | 2/1982 | Martin, Jr. | 220/371 |
| 4,537,119 | 8/1985 | Jarnot | 98/52 |
| 4,786,812 | 11/1988 | Humphreys | 250/455 |
| 4,896,590 | 1/1990 | Groos | 98/6 |
| 4,901,538 | 2/1990 | Anthony | 62/237 |

*Primary Examiner*—Bernard Nozick

*Attorney, Agent, or Firm*—Brooks Haidt Haffner & Delahunty

[57] ABSTRACT

A rail car unloading aspiration unit includes a rail car nozzle for providing air conduits for feeding conditioned air to the rail car and for withdrawing air therefrom, ambient air being drawn between a weather shield, hood or cover and a fan chamber mounted on a heating chamber which forces ambient air to pass through a filter and be heated within the range of approximately 77° F.-95° F. The heated air is passed in proximity to ultra violet lamps after which the air is directed into the rail car nozzle and expelled into the interior of the rail car head surface above the product being unloaded. During the time that power is applied to the aspiration unit, the fan forces air to be drawn into the unit and conditioned, and the ultra violet lamps remain on. However, the heaters are selectively activated or deactivated as a function of the temperature of the incoming air in order to maintain the temperature of the air within the desired ranged prior to being exposed to the ultra violet lamps.

10 Claims, 6 Drawing Sheets

ASPIRATION UNIT FOR CONDITIONING AIR DURING RAIL CAR UNLOADING OF PERISHABLE FOOD PRODUCTS

BACKGROUND OF THE INVENTION

1. Field of the Invention

The invention generally relates to apparatus for purifying and sterilizing ambient air, and more specifically to an aspiration unit for conditioning ambient air during rail car unloading of perishable food products.

2. Description of the Prior Art

Perishable food products are often shipped in rail cars to bulk break stations. At these stations, the rail cars are unloaded into stainless steel tank trucks, which in turn deliver the food products to the ultimate customers. These break stations act as distribution points for varying perishable food products, such as corn syrup products. When the rail cars arrive at a break station for off-loading into trucks, the rail car must be properly vented. Trucks are connected via hoses to the bottom of the rail car and a product in liquid form, such as syrup, is pumped from the rail car to the truck. When this occurs, air must be supplied to the interior of the rail car to replace the syrup removed from the car. If the vent structures or access ports at the top of the rail car is merely opened to allow ambient air to flow in to avoid a vacuum in the head space above the liquid product being unloaded, various pollutants, including dust, bees, insects, air born yeast or mold spores, can enter into the car and contaminate the syrup. Furthermore, several days could pass before the rail car is again unloaded into a different truck at the same location. During this intervening time, cold air introduced into the rail car in the presence of warm syrup causes condensation to take place. The condensation on the metal surfaces inside the car causes dripping and provides areas for high potential of microbiological growths which leads to mold and bacteria formation.

In U.S. Pat. No. 4,896,590 to Groos, a railroad hopper car vent is disclosed which permits filtered air to be drawn into the rail car to take the place of the material that is being discharged. However, Groos merely teaches the use of a railroad hopper car vent that relies on a filter for removing contaminants from the ambient air prior to being admitted into the rail car. See also U.S. Pat. No. 4,315,579 to Martin, Jr. which discloses a venting and filtering mechanism for a milk tank vent and which utilizes a sheet of filter material secured to the closure member or manhole cover to prevent entry of contaminants into the interior of the tank.

U.S. Pat. No. 3,326,111 to Stevens also dislcoses a removable filter on a vent structure for a covered hopper railway car. The circulation of heated air through a railway car is disclosed, the heated air being fed into the bottom of the hoppers and exhausted at one end of the car. A shielding stream of electrically heated air is admitted at the other end of the car near the roof which flows along the roof to prevent moisture laden circulated air from striking the cold roof directly, and thus preventing condensation. The railway car described, however, is primarily designed to remove excessive moisture released by fruits and vegetables. Excessive moisture in the railway car, resulting from the respiration of such fruits and vegetables, can damage the product being transported.

It is also known to provide portable apparatus for heating or cooling ambient air outside of a car for providing the heated or cooled air to the inside of the car. See, for example, U.S. Pat. No. 1,811,529 to Barstow et al. which discloses a portable apparatus for conditioning perishable products in a railway car. The apparatus provides a pre-ripening gas and provides for maintenance of desired conditions of temperature and humidity. U.S. Pat. No. 1,921,178 to Wood discloses a temperature control apparatus installed outside a railway car. Here, the apparatus has a fan and cooling coils across which air is blown before entering the car. The objective in Wood is to maintain the cargo being transported within predetermined temperature ranges, below a predetermined temperature but not so low that the goods may be frozen or otherwise damaged. Provision is, therefore, made for cooling or heating the air directed into the refrigerator car to compensate for the outside or ambient air temperature.

While the earlier approaches, therefore, have recognized that air drawn into rail cars during unloading must be regulated in temperature and cleaned of contaminants, such units have not been fully effective in conditioning the ambient air by sterilizing, filtering and heating it prior to being directed into the head space of the railway car above the perishable food product.

While stationary and portable air purifiers have been known, such as those described in U.S. Pat. No. 3,757,479 to Sievers and U.S. Pat. No. 4,786,812 to Humphreys, these have been proposed for use in offices, hospitals, food processing centers and the like. However, in germicidal ultraviolet lamp units have not been combined with mechanical filtering and temperature control to optimize the conditioning of ambient air received within a rail car unloading of perishable food products.

Accordingly, it is an object of the present invention to provide an aspiration unit for conditioning air during rail car unloading of perishable food products which does not have the disadvantages encountered in the prior art units.

It is another object of the invention to provide an aspiration unit of the type under discussion which is simple in construction and economical to manufacture.

It is still another object of the present invention to provide an aspiration unit for use with rail cars which is both effective to remove large contaminants, such as insects, dust, air born yeast and mold spores, as well as bacterial contaminants.

It is yet another object of the present invention to provide an aspiration unit of the type under discussion which provides mechanical filtering, temperature control as well as ultraviolet exposure to ambient air before it is permitted to enter into the head space inside a rail car during removal of the contents thereof.

It is a further object of the present invention to provide an aspiration unit as suggested in the previous objects which can be easily positioned in place within a vent structure or access port of a rail car prior to the unloading of perishable food products, and easily removable after unloading has terminated. It is still a further object of the present invention to provide an aspiration unit as in the foregoing objects which can be utilized during extreme ambient temperature conditions, without materially affecting the effectiveness of the unit.

In order to achieve the above objects, as well as others which will become apparent hereafter, a tank car unloading aspiration unit in accordance with the present invention for conditioning air received within the head space inside a tank car during removal of the contents of the tank car and replacement of the removed contents with the air comprises an air transfer portion configurated and dimensioned to be received within an access port in the roof of a rail tank car. Inlet conduit means is provided for directing conditioned air into the head space and outlet conduit means for removing air from the head space. Cover means is provided for covering the aspiration unit, and intake means for admitting ambient air into the unit. Conditioning means between said cover means and said air transfer portion condition the ambient air by heating the air to a temperature within a predetermined range and exposing the air to electromagnetic radiation. Air movement means is provided for drawing ambient air through said intake means and expelling the conditioned air through said inlet conduit means after passage of the ambient air through said conditioning means.

BRIEF DESCRIPTION OF THE DRAWINGS

These and other objects and advantages of the present invention will be readily appreciated as the same become better understood by reference to the following detailed description when considered in connection with the accompanying drawings, in which.

DESCRIPTION OF THE PREFERRED EMBODIMENT

Figure 1:
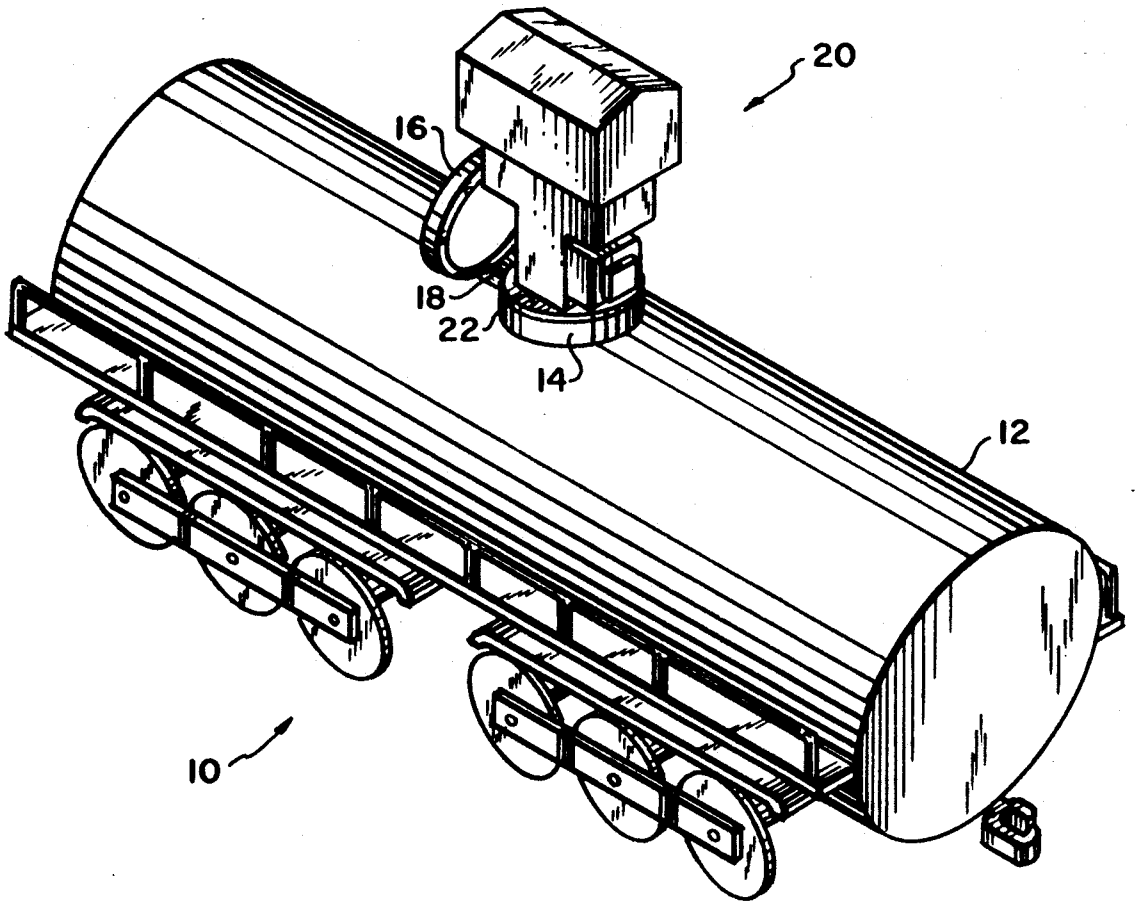
FIG. 1 is a perspective view of a rail car on which an unloading aspiration unit in accordance with the present invention is mounted through an access port or rail car manhole.

Referring now specifically to the drawings, in which identical or similar parts are designated by the same reference numerals throughout, and first referring to FIG. 1, there is shown a rail tank car 10 of the type in which, for example, corn syrup is transported. The rail car 10 includes a tank or container 12 which serves as a storage vessel from which the transported product, such as corn syrup, can be off-loaded into stainless steel tank trucks which in turn deliver the product to the ultimate customers. The tank or container 12 is typically provided with an access port, manhole, or manway hole 14 which can be selectively closed with a cover 16 into sealing engagement with the access port by movement about a hinge 18. Such sealing can be effected with any conventional ring gasket, such as those made of neoprene or synthetic rubber may be used.

In order to provide proper venting to the rail car when pumping off syrup and maintenance of good air quality in the air space above the syrup inside the rail car, an unloading aspiration unit 20 in accordance with the present invention is provided which is dimensioned to be mounted on the rail car 10 as shown, with at least a portion of the aspiration unit received within the tank or container 12 below the access port 14 and the rest of the unit projecting upwardly above the tank or container. As suggested, when syrup is removed from the rail car, air must be supplied to replace the removed syrup. The air must be of good quality to protect the integrity of the syrup product. The function of the aspiration unit 20 is to remove dust, dirt and microbiological contaminations which may contaminate the syrup or other food product, and which eliminates condensation and dripping in the rail car which could lead to mold and bacterial growth when air is drawn into the rail car while the syrup is unloaded.

Figure 2:
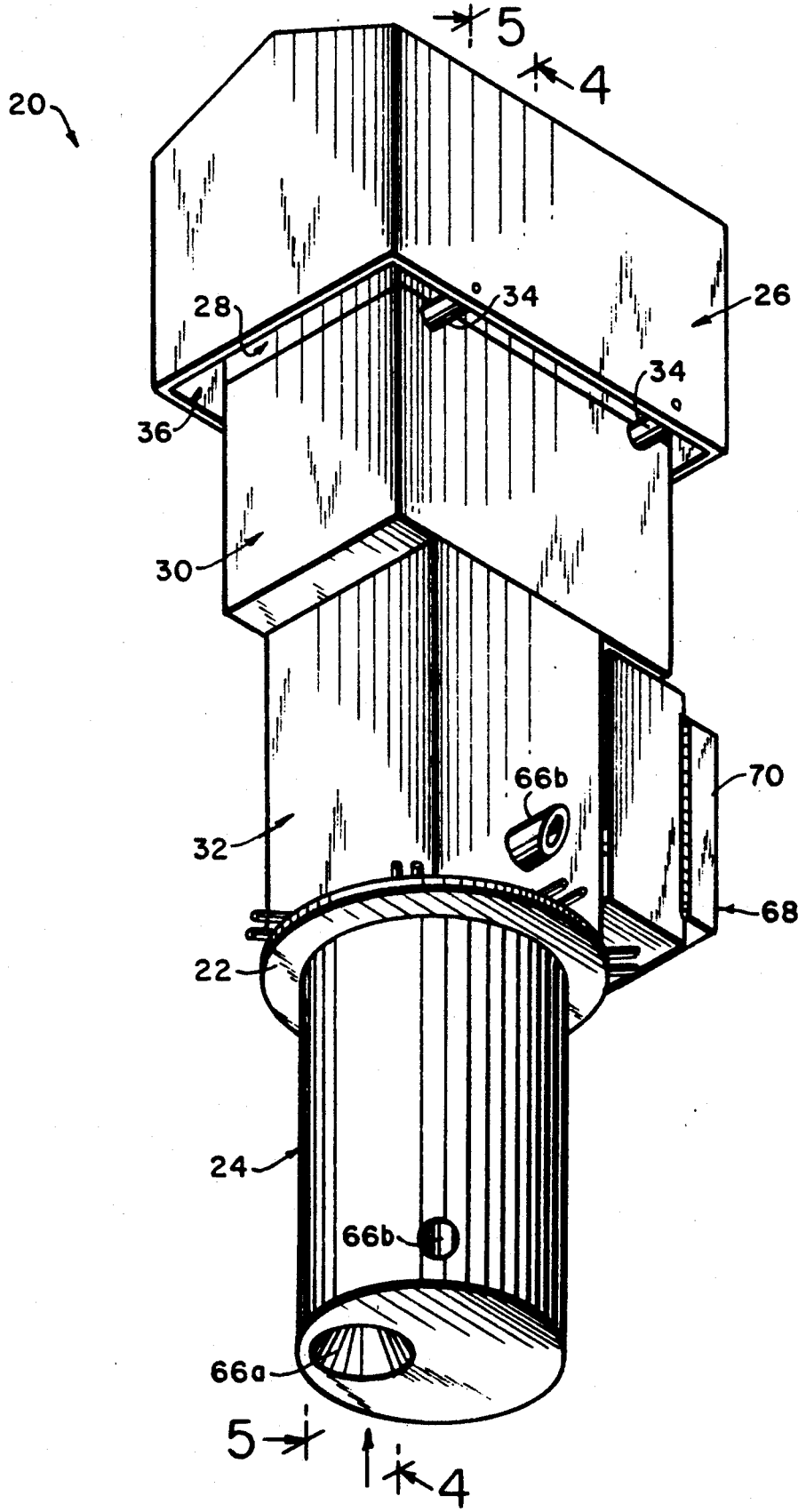
FIG. 2 is a perspective view of the unloading aspiration unit shown in FIG. 1, shown enlarged and from an angular view below the unit.

Referring to FIG. 2, the unloading aspiration unit 20 includes a rail car nozzle 24 which is received within the manhole or manway hole of the access port 14 and is, therefore, received within the tank or container 12 when the aspiration unit is mounted on the rail car. While the rail car nozzle 24 is disposed below the cover plate 22, the remainder of the aspiration unit is disposed above the cover plate.

At the top of the aspiration unit 20 there is provided a weather shield, hood or cover 26 which has four walls and a pitched roof, as shown, and is provided with an apertured plate member 26' (shown in FIG. 3) which facilitates the lifting and positioning of the aspiration unit.

Figure 3:
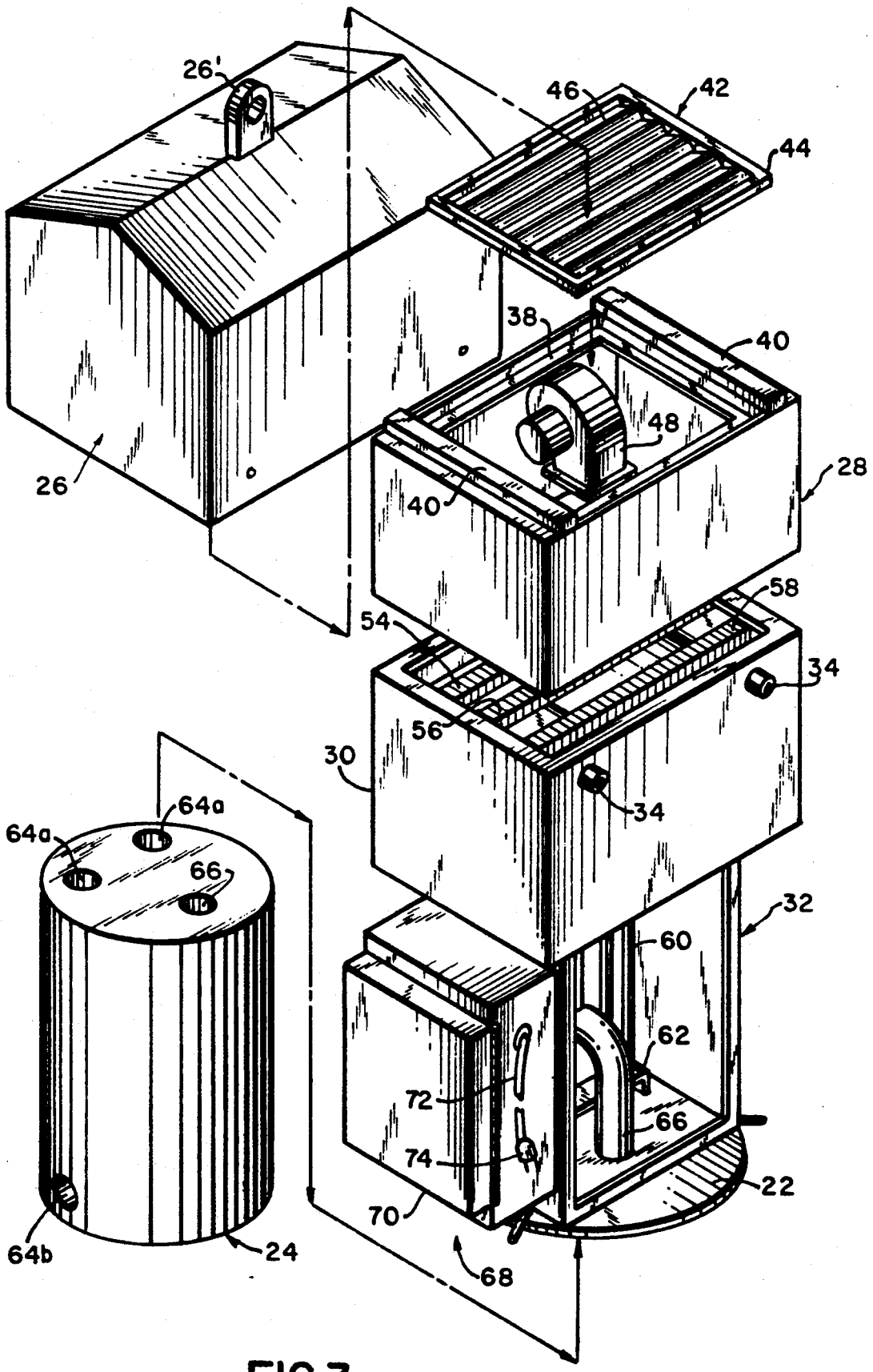
FIG. 3 is an exploded perspective view showing the various elements or components of the unloading aspiration unit shown in FIG. 2, showing the manner in which the various portions of the unit are arranged relative to each other.
Figure 4:
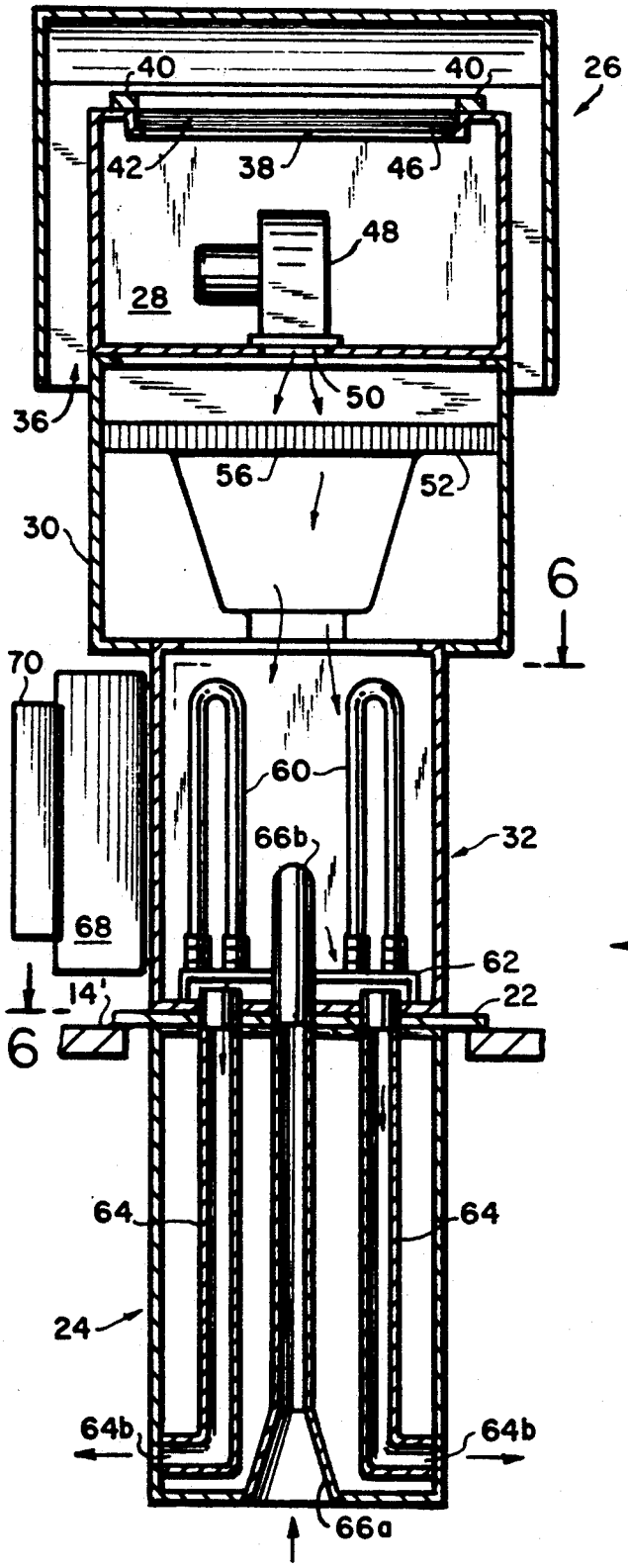
FIG. 4 is a cross-sectional view of the unloading aspiration unit shown in FIG. 2, taken along line 4—4 in FIG. 2.
Figure 5:
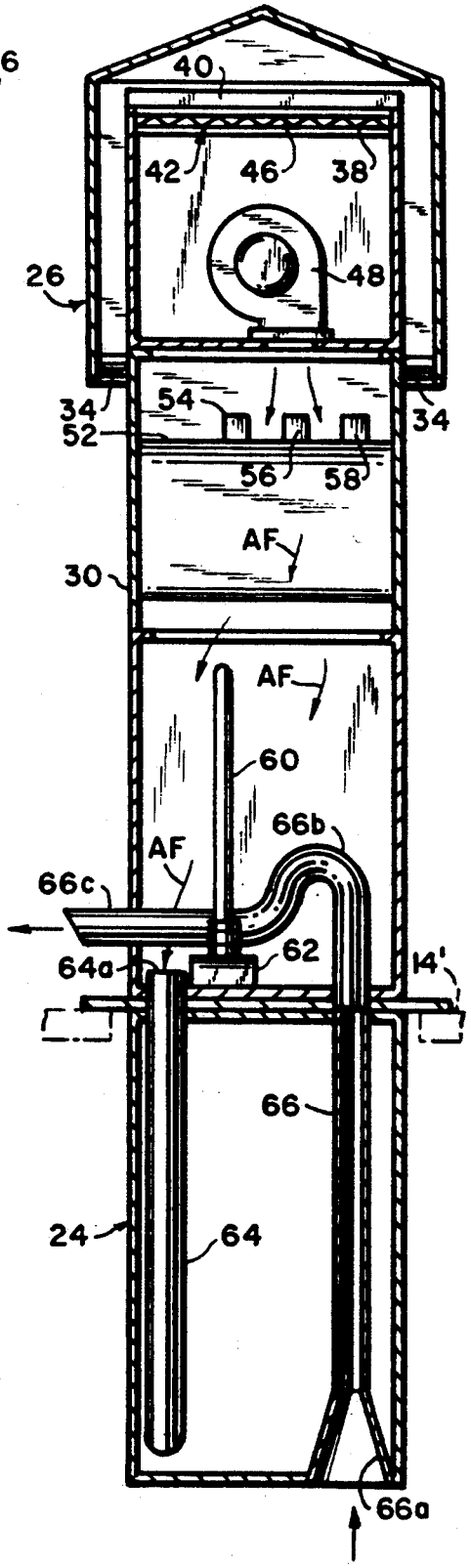
FIG. 5 is a cross-sectional view of the unloading aspiration unit shown in FIG. 2, taken along 5—5 in FIG. 2.

Also referring to FIGS. 3-5, the hood 26 encloses, in spaced relation, a fan chamber 28 which is supported on a heating chamber 30, which itself is mounted on an irradiation chamber 32 secured to the cover plate 22. As shown in the Figures, the walls of the hood 26 are substantially uniformly spaced from the walls of the fan chamber 28 and mounted thereto by means of mounting standoffs or spacers 34 to provide an air inlet clearance space 36 which extends about the periphery of the unit. Referring to FIGS. 3-5, the fan chamber 38 has a substantially rectangular opening at the upper end thereof which is defined by a recessed peripheral ledge 38. Upwardly projecting transverse spacers 40 are provided on at least one pair of opposing sides of the fan chamber 28, to provide a ledge for securely receiving an air filter 42. The air filter 42 includes a frame 44 dimensioned to be received within the recessed peripheral ledge 38 and a porous filter material 46 of any suitable type for removing undesirable contaminants.

Referring to FIG. 4, there is provided within the fan chamber 28 a fan 48 which has its exhaust port substantially aligned with an opening 50, the fan functioning to direct air that is passed through the filter 42 through the opening 50 into the heating chamber 30.

Figure 7:
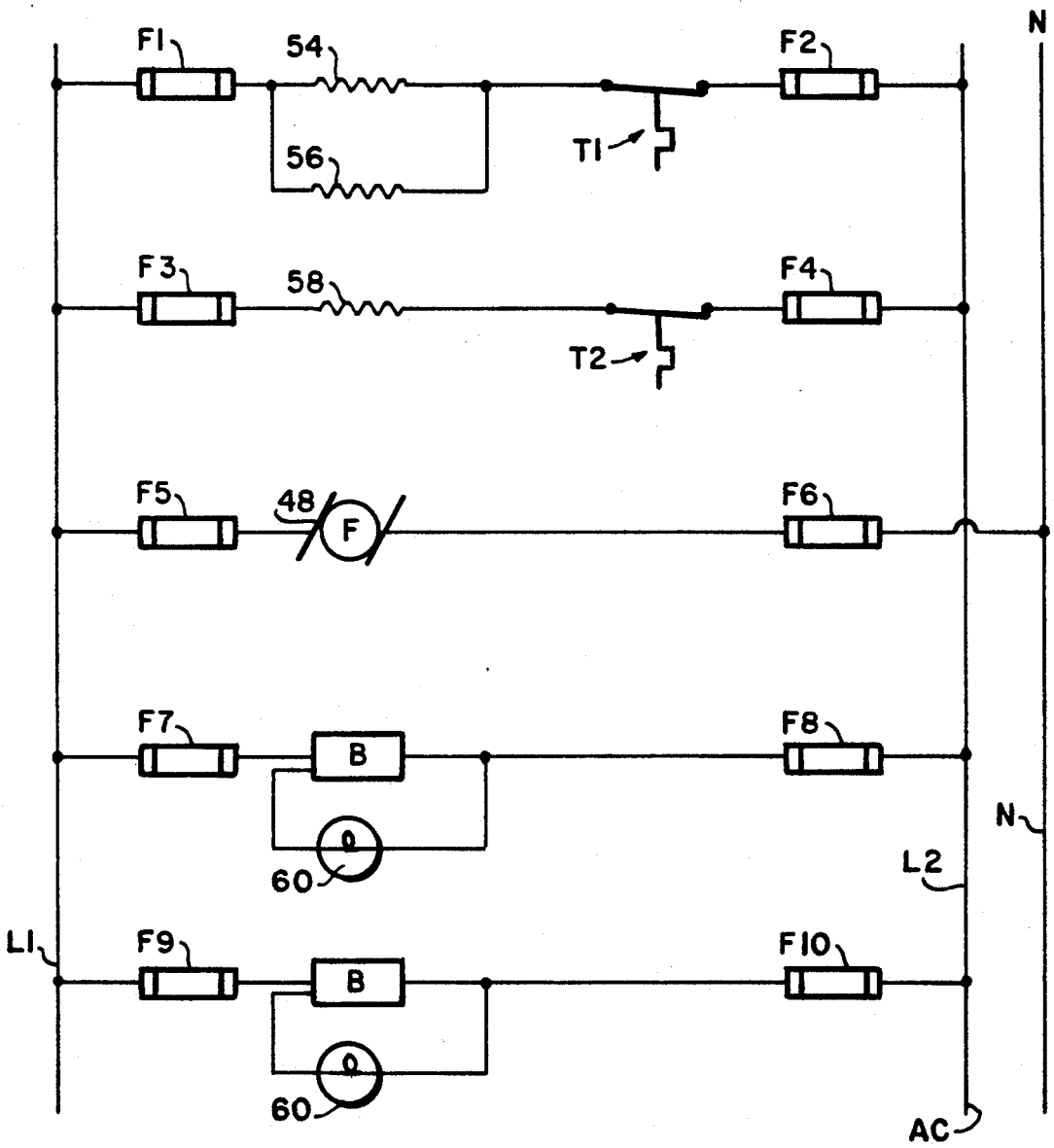
FIG. 7 is an electrical schematic diagram illustrating the electrical circuit which is used in conjunction with the unloading aspiration unit of the previous figures.

Provided within the heating chamber 30 is a support platform 52 on which three heaters 54, 56 and 58, to be more fully described in connection with FIG. 7, are arranged substantially in the path of the air flow AF which is forced through the heating chamber 30 by the fan 48.

The air is then directed into the irradiation chamber 32 and exposed to at least one ultra violet lamp 60, two being shown mounted on a support bracket 62.

Figure 6:
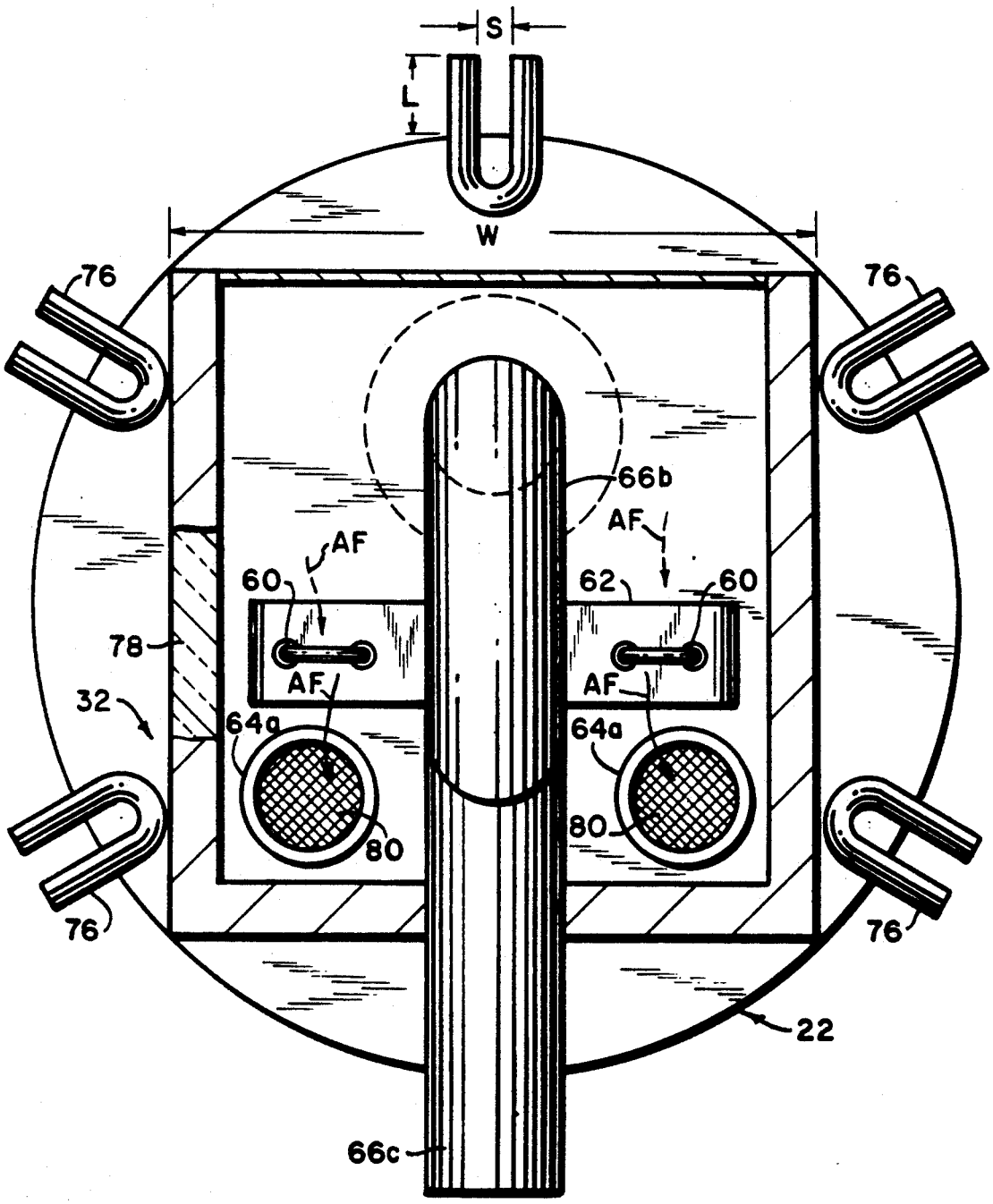
FIG. 6 is an enlarged top elevational view of the radiation chamber, partially broken away to show the insulation within the wall of the radiation unit and showing details of the cover plate and the means of mounting the unit on the rail car.

The rail car nozzle 24 is provided with two air inlet pipes 64, each having an upper inlet opening 64*a* between an associated ultra violet lamp 60 and a wall of the radiation chamber 32, and having an air outlet 64*b* which is arranged at substantially a right angle to the downwardly directed inlet tube or pipe 64 so as to release the conditioned air in a substantially horizontal direction. As best shown in FIGS. 5 and 6, the upper inlet portion 64*a* of the inlet tube or pipe 64 is so arranged in relation to the ultra violet lamps that the stream of air AF is forced to pass through the ultra violet lamp 60 in order to reach the upper lamp portion 64*a*. In this manner, it is assured that the air will be exposed to the ultra violet lamps. Excess air is received within the flared end 66*a* of air outlet pipe 66 of the rail car nozzle 24, and an air outlet pipe 66*b* connects the air outlet pipe 66 with an air outlet pipe portion 66*c* which exhausts excess air exteriorally of the tank or container 12 above the cover plate 22. Outlet pipe portion 66*c* should be provided with a screen (not shown) to prevent insects from entering the unit.

As is also clear from FIGS. 4 and 5, the cover plate 22 is supported, during use of the aspiration unit, on the upper surface 14' of the rail car or access port.

Mounted on one wall of the irradiation chamber 32 is a thermostat and ballast housing or electrical box 68 which has an access door panel 70 and a power line 72 which can be connected to a source of power by means of a plug 74.

Referring to FIG. 6, the cover plate 22 is shown to be provided with six equally spaced U-shaped retaining members which have a length dimension L of approximately two inches and which have a spacing between the legs or arms thereof S equal to approximately 1.5 inches. These retaining members can be used to clamp the cover 22 in sealing engagement to the access port 14 by using the same bolts as are used to hold down the cover 16. The walls of the irradiation chamber 32 are advantageously provided with insulation 78, as shown. Also, the upper ends or portion 64*a* of the air inlet tubes or pipes 64 are provided with a mesh screen 80 which prevents larger particles and contaminants from entering into the rail car.

In FIG. 7, the electrical circuit for controlling the various electrical components of the device is illustrated. As will be noted, the various electrical elements or components are connected between AC power lines L1 and L2, with the neutral line N also being provided. In one leg, the two heaters 54 and 56 are shown connected and parallel and fuses F1 and F2 being provided at both ends of the series connection of the heaters and thermostat T1. The third heater 58 is connected between the same power lines and is protected by fuses F3 and F4. Both heater circuits are provided with a temperature regulating means in the nature of a thermostat, T1 for the first two heaters and T2 for the second heater. The fan 48 is connected between the AC line L1 and the neutral line N, and is protected by fuses F5 and F6. Each of the ultra violet lamps 60 is provided with a similar circuit, connected in parallel across the AC power lines L1 and L2, each ultra violet lamp being connected to a ballast B and protected on each side by fuses F7, F8 and F9, F10 respectively.

The operation of the unloading aspiration unit will now be described. When the rail car is to be unloaded, the cover 16 is opened to expose the access port 14. The entire aspiration unit is thereupon lowered through the rail car manhole or manway hole and positioned to provide sealing contact between the lower surface of the cover plate 22 and the upper surface of the access port 14. The manner in which such seal is provided is well known to those skilled in the art and will not be discussed in detail.

After the aspiration unit 20 is mounted in place, as shown in FIGS. 1, 4 and 5, the electrical box 68 is connected to suitable AC power lines so as to provide power across the parallel circuits shown in FIG. 7. When 220 volts is applied to the control circuit, the fan 48 is immediately energized and air is drawn into the aspiration unit through the air inlet space or clearance 36, which air is forced through the air filter 42. The ballasts B also immediately turn on the ultra violet lamps, and these lamps remain on, as does the fan 48, until the AC power is removed. Typically, the fan provides approximately 150 cubic feet per minute ("cfm") of air to the unit. This volume of air will be heated as it passes through the heaters 54, 56 and 58. The thermostats T1 and T2 are adjusted in order to maintain the air within the range of approximately 85 ° F.–95° F. The heater 58 will open, i.e. the power will be shut off (via temperature switch of the thermostat) when the temperature is over 95° F. The two heaters 54 and 56, on the other hand, are adjusted to open when the temperature of the air is over 85° F., i.e. heater 58 is the only heater which is on. If the temperature is below 85° F., then all three of the heaters 54, 56 and 58 are on. It has been found that at temperatures less than 40° F. spores, bacteria and yeast are not killed when exposed to the UV light, whereas significant kill rates take place above 40° F. To provide a 100% kill condition, the air temperature must be heated to approximately between 80°–90° F.

The temperature probes for the thermostats are located in the irradiation chamber (not shown) where the ultra violet lamps are located below the heating chamber.

It should be clear that with the unloading aspiration unit 20 in accordance with the present invention, ambient air can be drawn into the unit in order to condition the same and expelled after passage of the air through the unit and through the interior of the tank car.

What has been described is a preferred embodiment of the present invention in which modification and changes may be made without departing from the spirit and scope of the accompanying claims.

I claim:

1. Rail tank car unloading aspiration unit for conditioning air received within the headspace inside a rail tank car during removal of the contents of the rail tank car and replacement of the removed contents with conditioned air, the unit comprising an air transfer housing portion configured and dimensioned to be received within an access port in the roof of a rail tank car, and including inlet conduit means for directing conditioned air into the headspace and outlet conduit means for removing air from the headspace; cover means for covering the unit; an intake means for admitting ambient air into the unit; conditioning means between said cover means and said air transfer portion for conditioning the ambient air by heating the air to a temperature within a predetermined range and exposing the air to electromagnetic radiation; and air movement means for drawing ambient air through said air intake means and expelling the conditioned air through said inlet conduit means after passage of the ambient air through said conditioning means.

2. The rail tank car unloading aspiration unit as defined in claim 1, further comprising temperature regulating means forming part of said conditioning means for regulating the heating of the ambient air to a temperature within the approximate range of 77° F. to 95° F. as the ambient air passes through said conditioning means.

3. The rail tank car unloading aspiration unit as defined in claim 1, further comprising temperature regulating means forming part of said conditioning means for regulating the heating of the ambient air to a temperature within the approximate range of 85° F. to 95° F.

4. The rail tank car unloading aspiration unit as defined in claim 1, wherein said conditioning means includes ultra-violet lamps for producing the electromagnetic radiation in the form of ultra-violet light, whereby the heated ambient air is exposed to ultraviolet light as it passes through said conditioning means.

5. The rail tank car unloading aspiration unit as defined in claim 1, wherein said air movement means comprises a blower fan for drawing ambient air into the unit through said air intake means and forcing the ambient air to move through aid conditioning means and into the rail tank car through said air transfer portion. and 6. The rail tank car unloading aspiration unit as defined in claim 1, wherein said conditioning means includes heating means and irradiation means arranged along the direction of flow of the ambient air as it moves from said air intake means to said air transfer portion, said heating means being upstream and said irradiation means being downstream relative to each other along said direction of ambient air flow within said conditioning means, whereby the ambient air is heated prior to being irradiated.

7. The rail tank car unloading aspiration unit as defined in claim 6, wherein said irradiation means comprises at least one ultra-violet lamp for exposing the heated ambient air to ultra-violet light.

8. The rail tank car unloading aspiration unit as defined in claim 7, wherein said inlet conduit means is downstream of said at least one ultra-violet lamp along the direction of flow of the ambient air, whereby the exposure of the ambient air to ultra-violet light is optimized.

9. The rail tank car unloading aspiration unit as defined in claim 8, wherein said inlet conduit means comprises a plurality of air inlet tubes, a plurality of ultra-violet lamps being provided each one associated with another air inlet tube and being positioned proximate to and upstream of the associated air inlet tube relative to the direction of flow of the ambient air, whereby the exposure of that portion of the ambient air directed into each air inlet tube to ultra-violet light is optimized.

10. The rail tank car unloading aspiration unit as defined in claim 8, further comprising filter means between said air intake means and said blower means for filtering the incoming ambient air and removing pollutants and contaminants therefrom.

* * * * *